US009878463B2

(12) United States Patent
Yu et al.

(10) Patent No.: US 9,878,463 B2
(45) Date of Patent: Jan. 30, 2018

(54) CHAIN SAW

(75) Inventors: Xi Yu, Jiangsu (CN); Wei Deng, Jiangsu (CN); Xiulian Chen, Jiangsu (CN)

(73) Assignee: POSITEC POWER TOOLS (SUZHOU) CO., LTD (CN)

( * ) Notice: Subject to any disclaimer, the term of this patent is extended or adjusted under 35 U.S.C. 154(b) by 0 days.

(21) Appl. No.: 13/140,001

(22) PCT Filed: Dec. 16, 2009

(86) PCT No.: PCT/CN2009/075652

§ 371 (c)(1),
(2), (4) Date: Sep. 7, 2011

(87) PCT Pub. No.: WO2010/069253

PCT Pub. Date: Jun. 24, 2010

(65) Prior Publication Data

US 2011/0308096 A1 Dec. 22, 2011

(30) Foreign Application Priority Data

Dec. 16, 2008 (CN) ..... 2008 1 0189056
Dec. 23, 2008 (CN) ..... 2008 1 0185098

(51) Int. Cl.
*B27B 17/14* (2006.01)

(52) U.S. Cl.
CPC ..... *B27B 17/14* (2013.01)

(58) Field of Classification Search
CPC ..... B27B 17/14; B27B 17/10; B27B 2/00
(Continued)

(56) References Cited

U.S. PATENT DOCUMENTS 2,727,372 A * 12/1955 Haerther ..... F16D 7/027 464/47
2,991,637 A * 7/1961 Lochow ..... 464/57
(Continued)

FOREIGN PATENT DOCUMENTS

CN 1316944 A 10/2001
CN 1342112 A 3/2002
(Continued)

OTHER PUBLICATIONS

International Search Report for Application PCT/CN2009/075652, international filing date Dec. 16, 2009.

*Primary Examiner* — Jonathan Riley
(74) *Attorney, Agent, or Firm* — Duane Morris LLP; David T. Xue

(57) ABSTRACT

A chain saw includes a housing, a sprocket wheel which is provided in the housing for driving a saw chain, and a chain guide for guiding the movement of the saw chain. The chain guide extends out longitudinally from the housing and is movable longitudinally relative to the housing. The chain saw includes a chain tensioning device. The chain tensioning device comprises a driven member arranged on the chain guide and a driving member which drives the driven member to move the chain guide longitudinally and a rotating device rotating the driving member. A stepless clutch device is arranged between the rotating device and the driving member. The chain tensioning device presses the chain guide while it tensioning the saw chain. Thus it prevents effectively the chain guide from loosing after the saw chain is tensioned. The operation of the chain tensioning device is labor-saving. The chain tensioning device has a stable structure and it is hard to be worn.

7 Claims, 6 Drawing Sheets

(58) Field of Classification Search
USPC ..... 30/381–387; 192/55.1, 48.3, 48.5, 46, 192/85.23, 89.26, 89.27, 89.2, 66.31, 192/56.2, 41 R, 12 BA, 55.3, 45.013; 464/47, 46
See application file for complete search history.

(56) References Cited

U.S. PATENT DOCUMENTS 3,064,455 A * 11/1962 Gros ..... 464/47
3,287,935 A * 11/1966 Grunbaum ..... F16D 7/025 464/46
3,602,346 A * 8/1971 Daugherty ..... F16D 7/025 192/48.8
3,636,995 A * 1/1972 Newman ..... 30/386
4,129,943 A * 12/1978 Bricker ..... B27B 17/14 30/386
5,954,174 A * 9/1999 Costin ..... F16D 41/12 192/103 B
6,049,986 A * 4/2000 Calkins et al. ..... 30/386
6,237,228 B1 * 5/2001 Moody ..... B27B 17/14 30/381
6,532,671 B1 * 3/2003 Jong ..... B27B 17/14 30/386
6,564,459 B1 * 5/2003 Steinbrueck ..... B27B 17/14 30/369
7,322,114 B2 1/2008 Kawamura
7,434,502 B2 * 10/2008 Keeton ..... B27B 17/14 30/386
7,743,513 B1 * 6/2010 Fisher ..... B27B 17/14 30/383
2002/0124421 A1 * 9/2002 Hermes ..... B27B 17/14 30/386
2008/0099300 A1 * 5/2008 Youngwerth ..... F16D 43/10 192/103 A

FOREIGN PATENT DOCUMENTS

CN 1138620 C 2/2004
CN 1174841 C 11/2004
CN 2 920 593 Y 7/2007
EP 2 036 688 A2 3/2009
EP 2036688 A2 * 3/2009
GB 2452768 * 3/2009
JP 2003251602 A 9/2003
WO 98/33631 A1 8/1998

* cited by examiner

CHAIN SAW

TECHNICAL FIELD

The present invention generally relates to a chain saw, and more particularly to a chain tensioning device for a chain saw.

BACKGROUND OF THE INVENTION

A PCT patent application WO9833631, which is published on Aug. 6, 1998 discloses a chain saw with a chain tensioning device, in which, the chain guide of the chain saw is fixed between two clamping plates and then fixed on the housing with them, and it can move longitudinally corresponding to the housing. Through a hole of the eccentric wheel and a rectangular hole on the housing, a bolt is tightened on the clamping plates which are guided and can move longitudinally on the housing, and its bolt head fixes the eccentric wheel on the housing. In order to tension the chain, first loosen the bolt and rotate the eccentric wheel, so that the bolt and clamping plates will move toward the direction of the chain guide top; when the chain has reached the expected tension, stop rotating the eccentric wheel, and then tighten the bolt again, so that the eccentric wheel and the clamping plates are fixed on the set position on the housing by force. This chain tensioning process is relatively complicated, and the fixation of the chain guide tends to loosen, which may cause the saw chain to be loose and increases the danger of the chain to jump from the chain guide. Therefore, this problem can only be solved by frequently conducting follow-up tensioning to the saw chain.

In order to solve the chain saw tensioning problem mentioned above, a Chinese patent CN1174841C, which is published on Nov. 10, 2004 publishes a chain saw, which has a chain tensioning device. This chain saw has a housing as well as a sprocket wheel installed on the housing and a chain guide aiming at this sprocket wheel, this chain guide extends from the housing and guides the saw chain engaged with the sprocket wheel in a circular manner, this chain guide can be installed in a manner that it can be movably adjusted longitudinally against the housing and sprocket wheel by a tensioning device, and the tensioning device has a stop fixed on the chain guide and an eccentric wheel which can be driven by the rotation of a rotating element. This rotating element is composed of two housing-like internal and external hand wheels, the internal and external hand wheels are inserted to each other and rotate against each other around a common axis, during which, the internal hand wheel move along the axis corresponding to the housing and it can be fixed on the chain guide, the external hand wheel and the eccentric wheel are connected to each other in a carry-rotation way, and the internal and external hand wheels, the external hand wheel and the housing are connected by an offside clipping connector, and when the saw chain has been tensioned, this offside clipping connector can ensure relative static connection between the internal and external hand wheels. Through the structure mentioned above, after its chain has been tensioned, the chain guide of the chain saw won't get loosed easily, which can guarantee effective tension of the saw chain. However, during the tensioning process, it requires separate operations to the internal and external hand wheels, which are complicated and the human-machine function is weak.

A Chinese patent CN1138620C has disclosed a chain saw, the chain saw includes a sprocket wheel movably installed on the housing which is used in the saw chain guided on the chain guide, an eccentric wheel that makes the chain guided move longitudinally and a chain tensioning device with a rotating device that makes the eccentric wheel rotate. of which, the rotation and connection device between the rotating device and eccentric wheel is constituted by a detent overload clutch, corresponding to the required chain tension to adjust its transposition clamping force. During the tensioning process of the chain, this structure only has to operate on one rotating device, and the chain can be tensioned and the chain guide can be clamped at the same time. It has convenient operation and strong human-machine function, but the detent overload clutch tends to be worn and the structure is not stable enough. In addition, during backward rotation of the rotating device to exchange the chain, efforts need to be made to overcome the clamping resistance between the detent elements of the detent overload clutch, and the operation is not easy.

SUMMARY OF THE INVENTION

Regarding the above weakness the present invention is to provide a chain saw, which includes a chain tensioning device which is stable, anti-abrasive and labour-saving.

In order to solver the above problems, the chain saw according to the invention comprises a housing; a sprocket wheel provided in the housing for driving a saw chain; a chain guide for guiding the movement of the saw chain, the chain guide extending out longitudinally from the housing and being movable longitudinally relative to the housing; and a chain tensioning device; the chain tensioning device comprises a driven member arranged on the chain guide, a driving member which drives the driven member to move the chain guide longitudinally, and a rotating device configured to rotate the driving member, and a stepless clutch device is arranged between the rotating device and the driving member.

According to a preferred embodiment of the invention, the stepless clutch device is embodied as a friction clutch, whose friction force is set in accordance with the required saw chain tensioning force of the chain saw.

According to an advantageous embodiment of the invention, a one-way driver is disposed between the rotating device and the friction clutch. The one-way driver comprises a clip member arranged on the rotating device, and a gear wheel arranged on the friction clutch for engaging with the clip member, the rotating device being configured to drive the friction clutch to rotate in a one-way direction via the clip member.

According to an advantageous embodiment of the invention, the chain saw comprises a shield, the shield comprises a shield opening with tooth-shaped end circumference face. The rotating device comprises a clamping sleeve, the hand wheel being stationary relative to the clamping sleeve. The friction clutch device includes an anti-looseness device made of elastic material, the anti-looseness device comprises an inclined plane which is alternatively be engagable with the slope on the hand wheel, and a tooth shaped piece which is alternatively engagable with the tooth shaped end circumference face.

According to an advantageous embodiment of the invention, the friction clutch comprises an elastic component providing with friction pressure and a friction plate subassembly biased by the elastic component. The friction plate subassembly comprises at least one friction plate and a rotating sleeve, the rotating sleeve being sleeved on periphery of the friction plate. The friction plate subassembly further comprises a friction plate base disposed between the driving member and the friction plate for driving the friction plate to rotate. The friction plate base connects the driving member with the friction plate, and the elastic component is disposed between the friction plate base and the friction plate. At least one clip member is arranged between the rotating device and the rotating sleeve for engaging with the gear wheel disposed on the periphery of the rotating sleeve, thus the clip member drives the rotating sleeve to rotate synchronously with the rotating device during the saw chain tensioning process.

According to an advantageous embodiment of the invention, the driving member is configured as an eccentric wheel, and the driven member is configured as a mounting stud fixed on the chain guide.

The chain saw according to the invention comprises a housing; a sprocket wheel provided in the housing for driving a saw chain; a chain guide for guiding the movement of the saw chain, the chain guide extending out longitudinally from the housing and being movable longitudinally relative to the housing; and a chain tensioning device. The chain tensioning device comprises a driven member arranged on the chain guide, a driving member which drives the driven member to move the chain guide longitudinally, a rotating device configured to rotate the driving member, a clutch device arranged between the rotating device and the driving member, and a one-way driver disposed between the rotating device and the clutch device.

According to an advantageous embodiment of the invention, the one-way driver comprises a clip member arranged on the rotating device, and a teeth shaped member disposed on a gear wheel, the clip member engaging with the teeth shaped member in one-way direction.

According to an advantageous embodiment of the invention, the clutch device is configured as a friction clutch, whose friction force is set in accordance with the required saw chain tensioning force of the chain saw.

The clutch device can also be configured as a detent clutch, whose detent force is set in accordance with the required saw chain tensioning force of the chain saw. The driving member is configured as a gear wheel, and the driven member is configured as a rack engaged with the gear wheel. The detent clutch comprises a first clip member, a second clip member, and a spring piece which can generate acting force between the first clip member and the second clip member for supplying clip and clutch force. The rack component further comprises at least one anti-looseness tooth. Moreover, the tensioning device comprises an anti-looseness device disposed between the detent clutch and the chain guide, the anti-looseness device engages with the anti-looseness tooth for limiting the position the chain guide during the tensioning of the saw chain.

The chain saw of the present invention includes a tensioning device, which can tension the saw chain and simultaneously tightly press against the chain guide, as well as preventing the saw chain from loosing and jumping off. The tensioning device is also stable, anti-abrasive and labour-saving.

BRIEF DESCRIPTION OF THE DRAWINGS

The present invention will be illustrated further with reference to the accompanying drafting and the detail description.

DESCRIPTION OF THE PREFERRED EMBODIMENT

Figure 1:
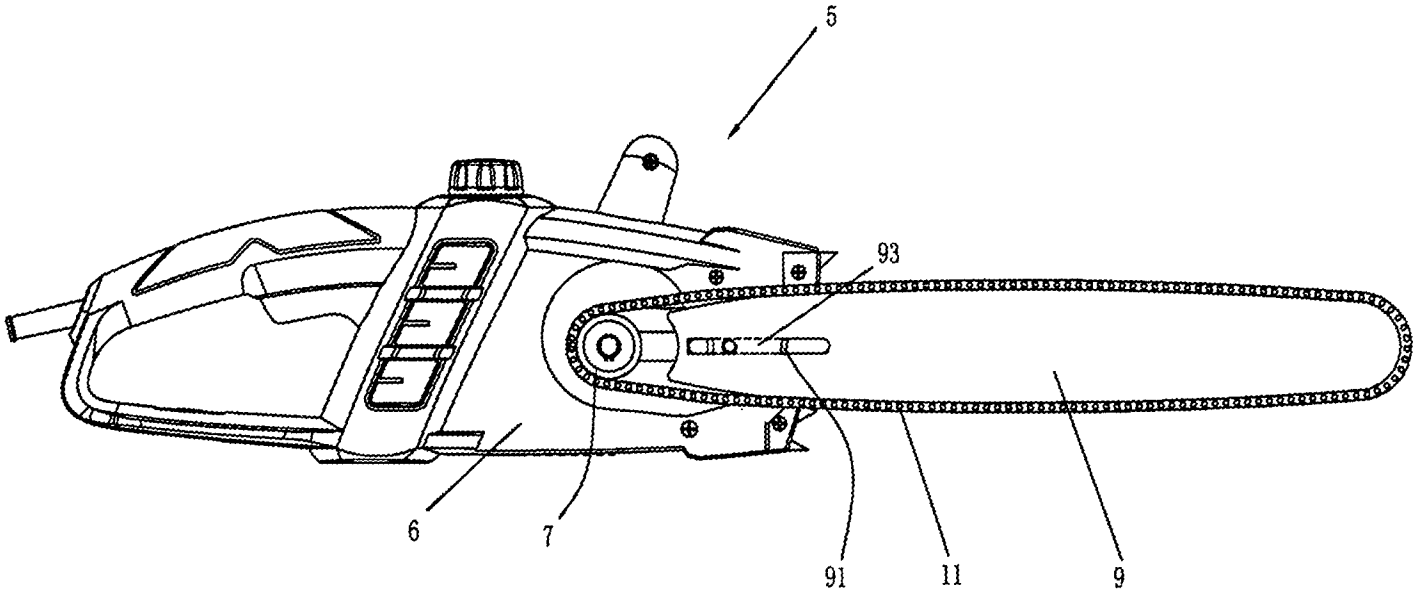
FIG. 1 is a partially principle view on a chain saw with the shield removed in the first embodiment.

As shown in FIG. 1, in one embodiment of the present invention, it involves a chain saw 5, which comprises a housing 6; a sprocket wheel 7 provided in the housing 6 for driving a saw chain 11; of which, this sprocket wheel 7 is driven by a power unit through a driver (not shown in the FIG. 1), and this power unit can be a motor or an engine; this chain saw 5 also includes a chain guide 9, one end of which is in the housing 6, and the other end of which extends out longitudinally from the housing 6; the saw chain 11 is cased around the sprocket wheel 7 and chain guide 9, and it can be guided along the edge of the chain guide 9 in cycles. In order to adjust the tension of the saw chain 11, this chain guide 9 can move corresponding to the housing 6 along the longitudinal extension direction of this chain guide 9, so that the distance between the chain guide 9 and the sprocket wheel 7 can be adjusted, and the saw chain 11 can be tensioned or loosed.

Figure 2:
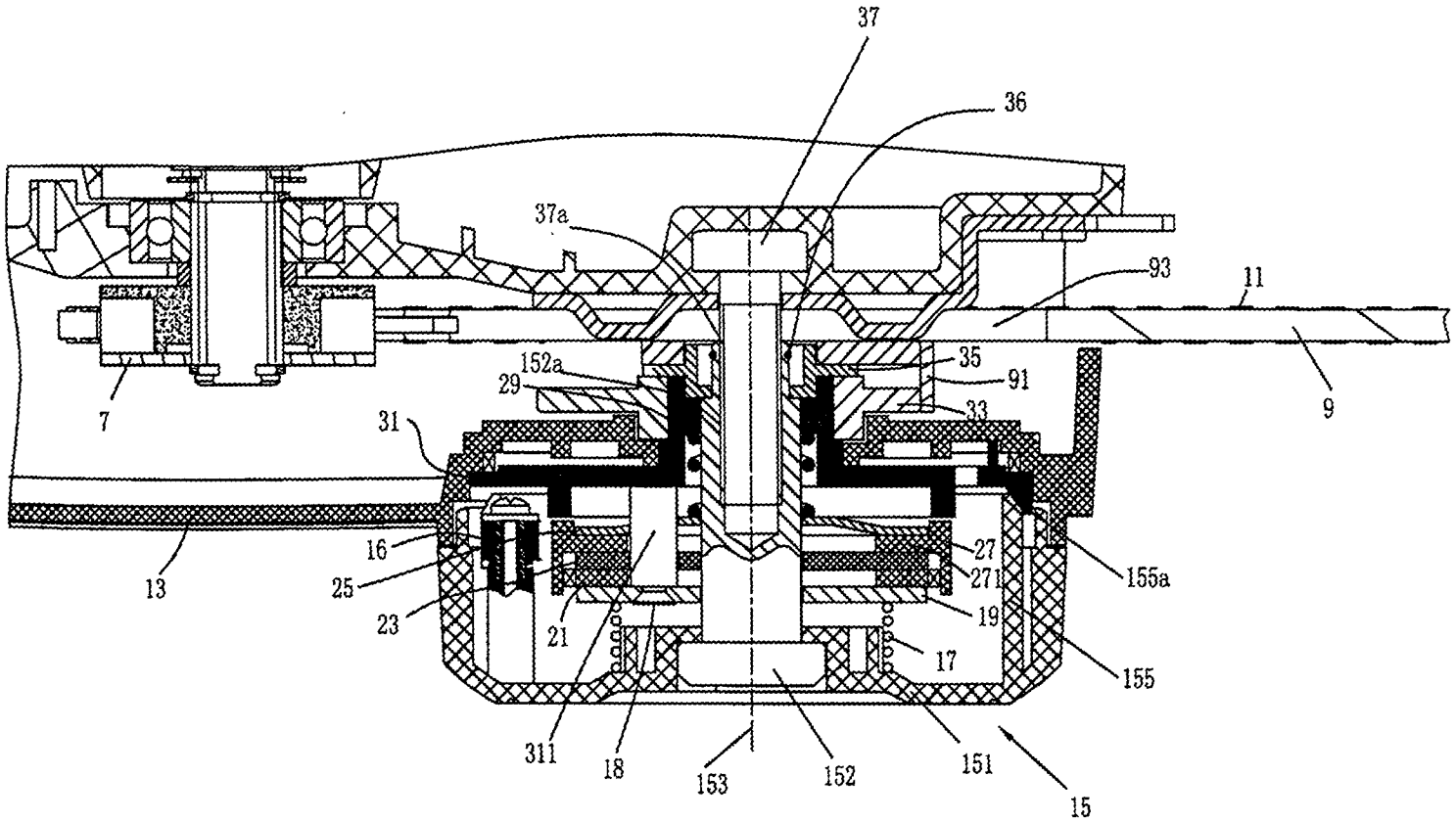
FIG. 2 is a sectional view of the tensioning device of the chain saw in the first embodiment.
Figure 3:
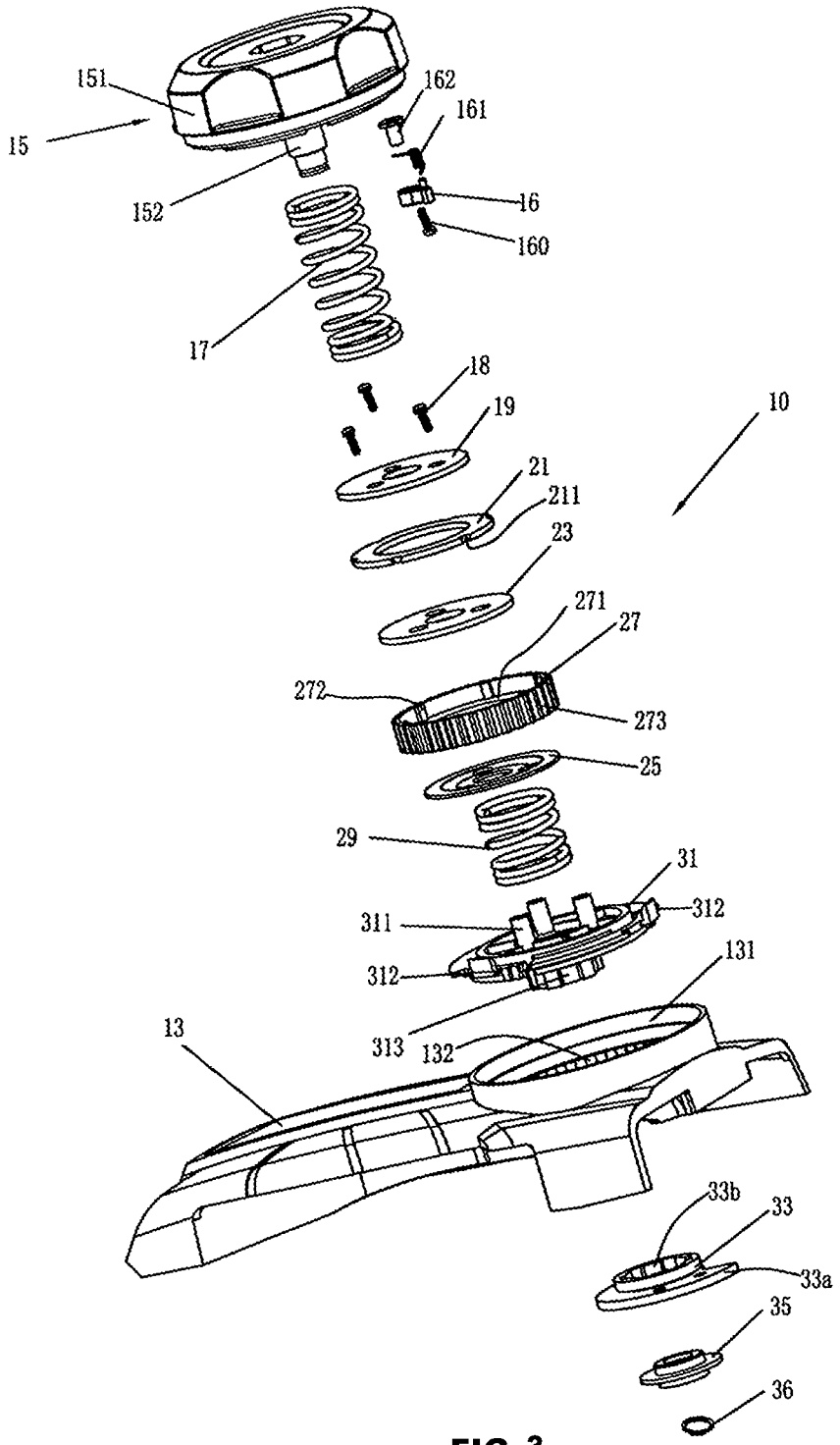
FIG. 3 is a explosive perspective view of the tensioning device of the chain saw in the first embodiment.

As shown in FIG. 2 and FIG. 3, in order to tension the saw chain 11 and fix the chain guide 9 on an appropriate position on the housing 6 in accordance with the adjusted tension of the saw chain 11, this chain saw 5 is installed with a chain tensioning device, which is installed in a shield 13 used to enclose the housing 6. Of which, this tensioning device includes a movable eccentric wheel 33 close to the side of the chain guide 9, a rotating device 15 which controls the rotation of the eccentric wheel 33 and a friction clutch 10; an outer arc 33*a* of the eccentric wheel 33 leans against a mounting stud 91 of the chain guide 9, and when the rotating device 15 operates the eccentric wheel 33 to rotate, this eccentric wheel 33 leans against the mounting stud 91 and propels this mounting stud 91 to move toward the housing 6 longitudinally along the longitudinal extension direction of the chain guide 9, then the mounting stud 91 drives the chain guide 9 to move away from the housing 6 longitudinally along the longitudinal extension direction of the chain guide 9, so the chain guide 9 is away from the sprocket wheel 7 and the saw chain 11 is tensioned; of which, the eccentric wheel 33 can also be structured as a worm gear or wheel gear, and the mounting stud 91 can be structured as a worm or a rack to match the worm gear or wheel gear, as long as it can make the rotating device 15 to drive the chain guide 9 move against the housing 6 along the longitudinal extension direction of the chain guide 9 through transmission.

The friction clutch 10 is a rotation and connection device installed between the rotating device 15 and the eccentric wheel 33, which is used to connect the rotating device 15 and the eccentric wheel 33. This friction clutch 10 generates friction force through its friction device, and the friction force refers to the limit value which the friction force on the friction device can reach when the friction clutch 10 is engaging and disengaging. The friction force corresponds to the ideal tension of the chain saw required by the chain saw 11 which has been adjusted in advance. During the tensioning process, when the saw chain 11 has completely fallen into a guide groove on the longitudinal edge of the chain guide 9, the movement resistance for the chain guide 9 increases gradually, the rotating device 15 keeps moving until the constraint force of the saw chain 11 on the moving chain guide 9 exceeds the friction force by the friction clutch 10, the friction clutch 10 makes the rotating device 15 unable to drive the eccentric wheel 33 to move, and the rotating device 15 keeps pressing against the chain guide 9 while the eccentric wheel 33 keeps a static state at this moment, i.e., the saw chain 11 has maintained a certain tension. Therefore, the friction clutch 10 can ensure that after tensioning the saw chain, the saw chain 11 can maintain the same tension; this tension is decided by the friction force of the friction clutch 10 which is preset in the factory, and it is not related to the personal feeling of the user, which makes it convenient for the user to reach the pre-designed tension state of the saw chain to realize optimum working process.

Among the most preferred embodiments of the present invention, the rotating device 15 includes a clamping sleeve 152 and a hand wheel 151 relatively static to the clamping sleeve 152; the clamping sleeve 152 has a central axis 153, and the eccentric wheel 33 and the clamping sleeve 152 can be connected through the friction clutch 10; the central axis 153 of the clamping sleeve 152 is coaxial with the rotation axis centre line of the eccentric wheel 33. Inside of the clamping sleeve 152, there is an internal thread 152*a*, and through this internal thread 152*a*, the clamping sleeve 152 matches with an external thread 37*a* of a bolt 37 with its one end fixed in the housing 6 which extends vertically from this housing 6 and passes through a rectangular hole 93 longitudinally extending on the chain guide 9, which makes the clamping sleeve 152 set vertical to the chain guide 9. Of which, the end of the clamping sleeve 152 close to the chain guide 9 is equipped with a press block 35, which is used to limit the eccentric wheel 33 between the friction clutch 10 and the chain guide 9 as well as to press the chain guide 9 after the chain saw 5 has been tensioned to maintain the tensioning degree of the chain saw 5; in this way, during the work process, the saw chain 11 won't be loosened due to vibration of the chain saw 5, which might cause danger to the user. In the meantime, the end of the clamping sleeve 152 close to the chain guide 9 is also equipped with a check ring 36, which is used to limit the press block 35 to prevent the press block 35 from coming off the clamping sleeve 152 and ensure stability of the structure. The other end of the clamping sleeve 152 is enclosed by the hand wheel 151 relatively static to the clamping sleeve 152 for the convenience of the user to operate the clamping sleeve 152; to this end, the clamping sleeve 152 and the hand wheel 151 match each other to ensure that the hand wheel 151 drives the clamping sleeve 152 to move together. In addition, the inside of the hand wheel 151 is set with an enclosing wall 155 along its periphery, and the tail end of the enclosing wall 155 forms a slope 155*a*.

The rotating device 15 passes the shield 13 and the circular shield opening 131 coaxial with the clamping sleeve 152; this shield opening 131 matches with the shape of the hand wheel 151, which makes it possible for the hand wheel 151 to be inserted into the shield opening 131 and drive the clamping sleeve 152 move corresponding to the shield 13, and it is convenient for the operation to tension the saw chain. In addition, the lower end of the shield opening 131 also has a tooth end face 132 along the periphery of the opening.

Figure 5:
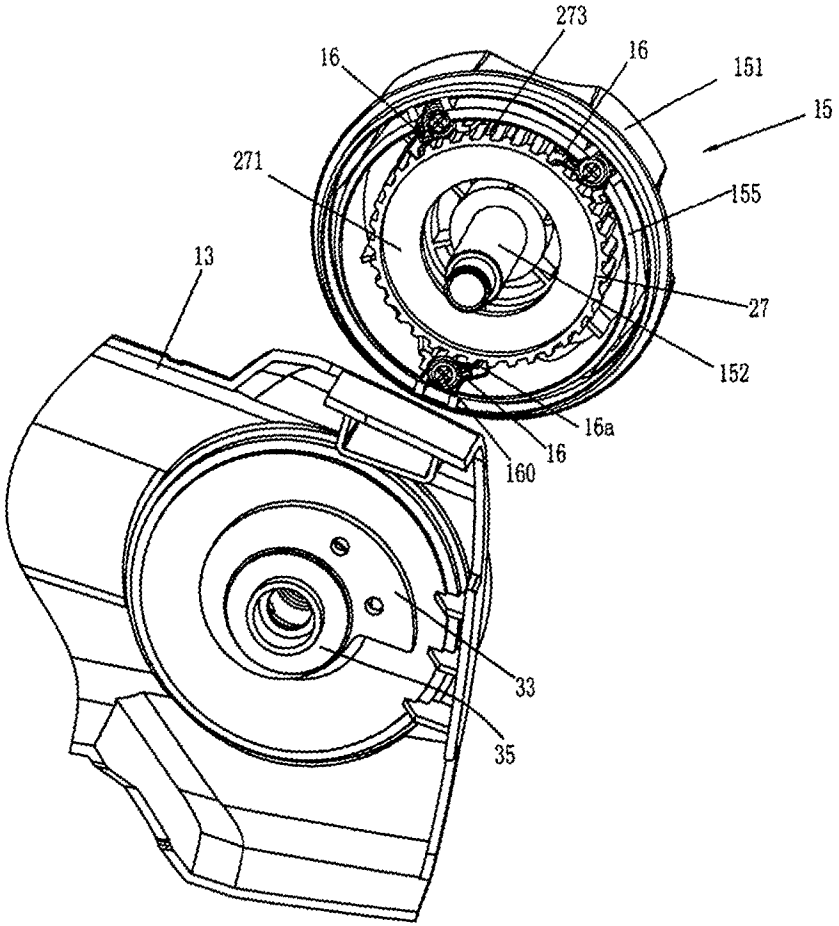
FIG. 5 is a schematic perspective view of the hand wheel engaging with the rotating sleeve of the chain saw in the first embodiment.
Figure 4:
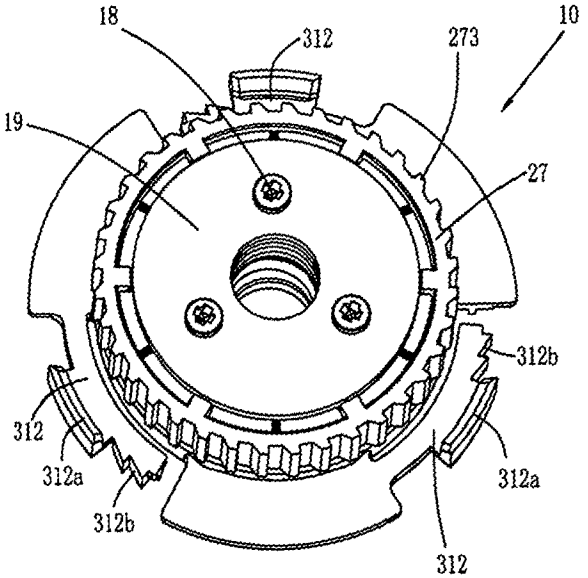
FIG. 4 is a top view of the friction clutch in the first embodiment.

As shown in FIG. 2 and FIG. 4, the friction clutch 10 comprises a friction plate subassembly, a friction plate base 31 and a prestressed clutch spring 29; of which, the friction plate subassembly includes a first friction plate 19, a second friction plate 21, a third friction plate 23, a fourth friction plate 25 and a rotating sleeve 27; the friction plate base 31 is equipped with an eccentric wheel connection device 313 on the side close to the eccentric wheel 33, the eccentric wheel connection device 313 and the friction plate base 31 are integral, which cooperates with the hole connection part 33*b* on the eccentric wheel 33 to connect the eccentric wheel 33; in this way, when the eccentric wheel connection device 313 has been connected with the eccentric wheel 33, the eccentric wheel 33 and the eccentric wheel connection device 313 can maintain static to each other. In addition, on the back side of the friction plate base 31 against the eccentric wheel 33, there is at least one friction plate connection 311, and in the best embodiment of the present invention, the friction plate base 31 is equipped with three friction plate connections 311, each of which is structured as a hollow threaded cylinder. Through a friction screw 18, the first friction plate 19, third friction plate 23 and fourth friction plate 25 pass through the connection hole on it which matches the friction plate connection 311, and connect the friction plate connection 311. Of which, the fourth friction plate 25 is close to the friction plate base 31, and the second friction plate 21 and third friction plate 23 are between it and the first friction plate 19; the second friction plate 21 is clamped between the first friction plate 19 and the third friction plate 23, and it is movably installed on the friction plate connection 311; the rotating sleeve 27 is installed on the back side of the friction plate base 31 against the eccentric wheel 33, which can contain the first friction plate to the fourth friction plate 25, and the rotating sleeve 27 comprises a gear wheel 273 on its periphery, its inner circumferential surface is installed with a circular friction lining 271 and a raised line 272 above the circular friction lining 271; of which, the circular friction lining 271 is installed between the third friction plate 23 and fourth friction plate 25, which separates the third friction plate 23 and fourth friction plate 25; the raised line 272 can be connected to the notch 211 on the edge of the second friction plate 21 to make the second friction plate 21 to statically connect the rotating sleeve 27. One end of the prestressed clutch spring 29 biases the friction plate base 31, and the other end biases the fourth friction plate 25 to provide the friction plate pressure and generate corresponding friction force this way. What's worth mentioning is that: the first friction plate 19, the second friction plate 21, the third friction plate 25, the fourth friction plate 27, and the circular friction lining 271 installed on the friction plate base 31 all have bigger friction coefficients, and the size of the friction force can be adjusted through the biased pressures the prestressed clutch spring 29 has imposed on them. In the meantime, the first friction plate 19, second friction plate 21, third friction plate 23, fourth friction plate 25 and the friction plate base 31 all have holes coaxial with the central axis 153 of the clamping sleeve 152, and the clamping sleeve 152 passes through the holes in them to connect the bolt 37; in addition, a limit pressure spring 17 is installed between the hand wheel 151 of the clamping sleeve 152 and the first friction plate 19, which biases the hand wheel 151 and the first friction plate 19 and gives the friction clutch 10 a limit force to prevent the friction clutch 10 from moving along the central axis 153 of the clamping sleeve 152 and causing instability to the tensioning device. See FIG. 3 and FIG. 4, the main part of the friction plate base 31 is evenly installed with multiple anti-looseness devices 312 along its periphery; there are three anti-looseness devices 312 in this embodiment, each with an inclined plane 312*a* extruding toward the direction of the hand wheel 151, and these inclined planes 312*a* can be selectively engaged with the slope 155*a* along the inner side 155 of the hand wheel 151; in addition, on the same side of each inclined planes 312*a*, a tooth piece 312*b* is installed, and this tooth piece 312*b* can be selectively engaged with the tooth end face 132 configured on the shield opening 131; there are two tooth pieces 312*b* in this embodiment, and both the tooth pieces 312*b* and inclined planes 312*a* of this friction plate base 31 are made of elastic materials For the convenience of the hand wheel 151 to drive the friction clutch 10 to tension the saw chain and to avoid overcoming a strong friction force when loosening the saw chain 11, as shown in FIG. 3, the inner edge of the hand wheel 151 is at least movably installed with one clip member 16 through the screw 160; in this embodiment, it is installed with three clip members 16 (see FIG. 5), and this clip member 16 includes a connection part connecting the hand wheel 151 and a clipping part 16*a* which matches the gear wheel 273 in shape; in order to cooperate with the connection part of the clip member 16, the inner periphery of the hand wheel 151 is installed with corresponding connection part 162 cooperated with the screw 160; a torsion spring 161 is installed between the clip member 16 and the connection part 162 of the hand wheel 151, and this torsion spring 161 can give the clipping part 16*a* of the clip member 16 an elastic force toward the center of the hand wheel 151, so that when the hand wheel 151 is connected to the friction clutch 10, the clipping part 16*a* of the clip member 16 can be one-way engaged with the gear wheel 273 on the outer periphery of the rotating sleeve 27, so a one-way driver will be formed between the rotating device 15 and the friction clutch 10, i.e., the clip member 16 can only one-way drive the gear wheel 273 to rotate, while the clip member 16 cannot drive the gear wheel 273 to rotate during backward rotation. When this one-way driver rotates the rotating device 15, the hand wheel 151 drives the clip member 16 to rotate, so the rotating sleeve 27 will be driven to rotate; when changing the saw chain, the chain guide has to be dismantled first, as long as to rotate the rotating device 15 backward at this moment, the clipping part 16*a* of the clip member 16 can crawl on the gear wheel 273 to make the rotating sleeve 27 maintain static while the hand wheel 151 keep rotating, which can also drives the clamping sleeve 152 to come off the bolt 37 installed on the housing 6, so that the shield 300 can drive the tensioning device to come off the chain saw 5. In addition to the single gripper ratchet mechanism disclosed in this embodiment, technicians in this field can also choose other one-way drivers, such as the OWC (one-way clutch), one-way bearing and other end-tooth ratchet mechanisms, internally connected ratchet mechanisms or fan-shaped ratchet mechanisms to realize one-way driving between the rotating device 15 and the friction clutch 10. Of course, hydraulic or pneumatic one-way valve can also realize one-way hydraulic or pneumatic transmission.

Through the structure mentioned above, the saw chain 11 tensioning and the chain guide 9 pressing of the chain saw in the present invention is realized in this way: when the user gets the chain saw 5 and needs to tension the saw chain 11, the shield 13 needs to be covered at corresponding location on the housing 6 to place the rotating device 15 of the tensioning device installed on the shield 13 to aim at and pass through the bolt 37 of the chain guide 9; secondly, rotate the hand wheel 151 to make the hand wheel 151 drive the clamping sleeve 152 to move longitudinally toward the chain guide 9 on the bolt 37 through screw thread fit; in the meantime, the hand wheel 151 cooperates with the gear wheel 273 on the outer periphery of the rotating sleeve 27 through the clipping part 16*a* of the clip member 16 to drive the rotating sleeve 27 rotate synchronously, which makes the rotating sleeve 27 to drive the second friction plate 21 engaged with raised line 272 on it to rotate synchronously, and under the friction force of the prestressed clutch spring 29, it drives the first friction plate 19 and third friction plate 23 to rotate synchronously; in the meantime, the rotating sleeve 27 also drives the third friction plate 23 and fourth friction plate 25 to rotate synchronously through friction force; in addition, because the first, third and fourth friction plates are fixed on the friction plate base 31 by the friction plate screw 18, they can drive the friction plate base 31 to rotate synchronously, which makes the friction plate base 31 be able to drive the eccentric wheel 33 connected with it to rotate synchronously and drive the longitudinal movement of the chain guide 9, and the saw chain 11 begins to be tensioned; at this moment, the tension of the saw chain 11 is smaller than the preset friction force generated by the spring 29 biasing the friction plate in the friction clutch 10. Keep rotating the hand wheel 151, and when the saw chain 11 reaches the optimum tension preset in the factory, the chain tensioning process of the chain saw 5 is completed; at this moment, the tension of the saw chain 11 forms a constraint to the reacting force of the chain guide 9, and this constraint is transmitted to the eccentric wheel 33 which matches the mounting stud 91 through the mounting stud 91 installed in the chain guide 9, which is further transmitted to the friction clutch 10 installed between the eccentric wheel 33 and the rotating device 15; at this moment, after the saw chain has finished the tensioning process, this reacting force exceeds the friction force mentioned above. Keep rotating the hand wheel 151, under the reacting force generated by the eccentric wheel 33, the friction clutch conducts engaging and disengaging; in this embodiment, i.e., the first friction plate 19, the third friction plate 23 and the second friction plate 21 overcome the friction force between them and come off; in the meantime, the third friction plate 23, the fourth friction plate 25 and the rotating sleeve 27 overcome the friction force between them and come off; in this way, the friction plate base 31 stops rotating, the eccentric wheel 33 maintains static, and the saw chain 11 remains its tension unchanged. What's worth mentioning is that: it is the optimum embodiment of the present invention to set four friction plates and a rotating sleeve 27 in order to stabilize the friction clutch 10; however, in fact, it only requires two frictional pieces to realize the role of the friction clutch 10 in the present invention through the friction force between them. The hand wheel 151 keeps rotating, and drives the clamping sleeve 152 and the press block 35 connected with the clamping sleeve 152 to keep moving toward the chain guide 9 and press the chain guide 9. At this moment, under the pressing force, the inclined plane 312*a* on the anti-looseness device 312 and the slope 155*a* along the inner side 155 of the hand wheel 151 are mutual engaging and pressing, which causes an elastic deformation extruding along the radial direction of the anti-looseness device 312, and the tooth piece 312*b* is engaged with the tooth end face 132 configured on the shield opening 131 along the radial direction, i.e., when the hand wheel 151 rotates to a state in which the chain guide is tensioned and tightly pressed, the friction clutch 10 and the shield 13 are automatically locked up together, which will ensure the chain guide 9 won't come off during the operation. When the saw chain needs to be changed, rotate the rotating device 15 backwardly to drive the clamping sleeve 152 move toward the position in which it can generate a pressing force against the bolt 37, so that the slope 155*a* along the inner side 155 of the hand wheel 151 is disengaged from the inclined plane 312*a* on the anti-looseness device 312, the anti-looseness device 312 recovers its elasticity, and the tooth piece 312*b* on the anti-looseness device 312 automatically comes off from its engagement with the tooth end face 132 configured on the shield opening 131, i.e., the anti-looseness mechanism automatically unlocks; at this moment, keep rotating the hand wheel 151 backwardly until the clamping sleeve 152 is disengaged from the bolt 37 stalled in the housing 6, so that the shield 13 can drive the tensioning device to come off the chain saw 5.

The friction clutch 10 adopted by this embodiment is a stepless clutch device, i.e., during engaging and disengaging, there is no requirement of locations of various clutch components and there is no abrupt change between them, which is different from the location requirement between the clip members of the clip clutch disclosed in the prior art. Of course, technicians in this field can also set other types of clutch devices in accordance with this embodiment.

Figure 6:
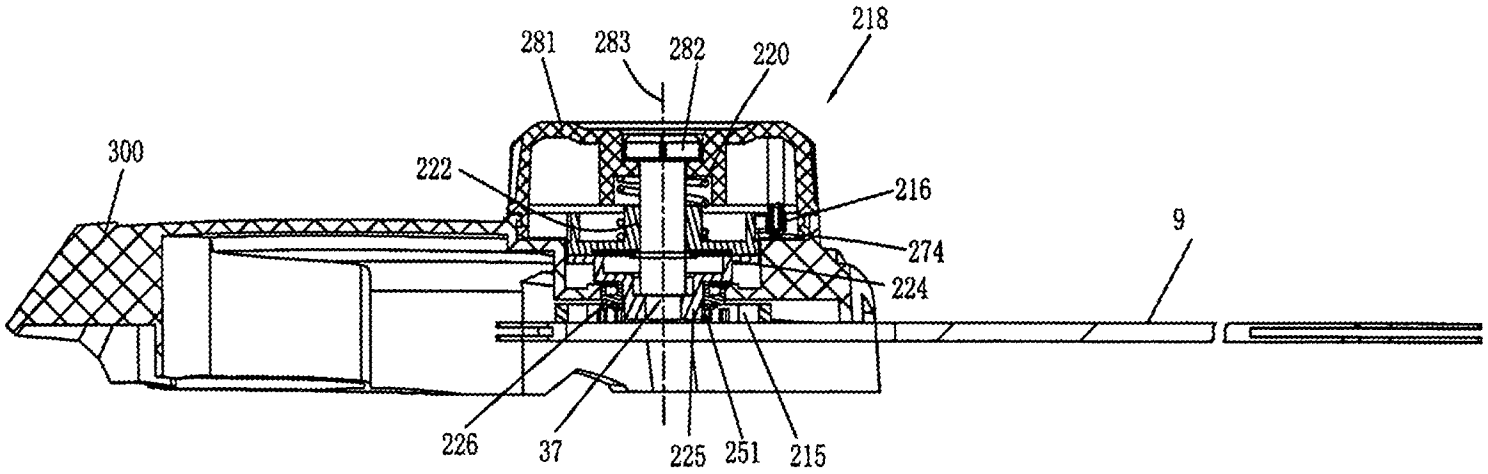
FIG. 6 is a sectional view of the tensioning device of the chain saw in the second embodiment.
Figure 7:
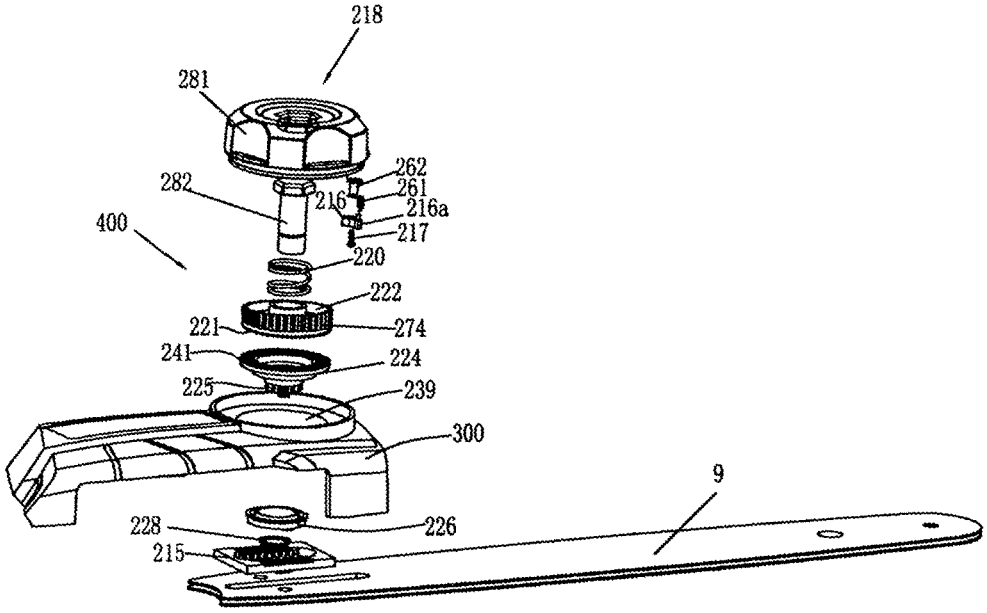
FIG. 7 is a explosive perspective view of the tensioning device of the chain saw in the second embodiment.
Figure 8:
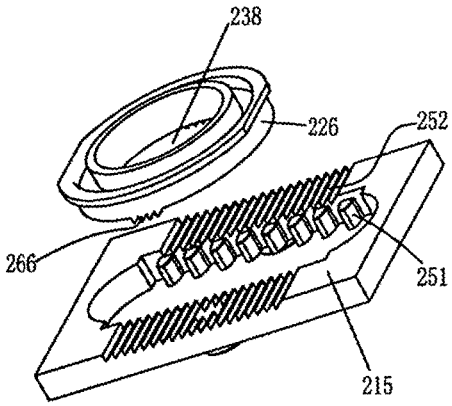
FIG. 8 shows a partial enlarged view of the tensioning device of the chain saw in FIG. 7.

As shown in FIG. 6, FIG. 7 and FIG. 8, the second embodiment of the present invention relates to a chain saw which is generally the same as that in the first embodiment, and the difference is in the use of a different chain tensioning structure. For the convenience of description, further elaboration will not be conducted after using the same signs to present the same components, and different components will be expressed by new signs.

This tensioning device includes a movable gear wheel 225 close to the side of the chain guide 9, a rack component 215 fixed on the chain guide 9 to engage with the gear wheel 225, a rotating device 218 which controls the rotation of this gear wheel 225 and a detent overload clutch 400. The gear wheel 225 cooperates with the rack 251 of the rack component 215, and when the rotating device 218 drives the gear wheel 225 to rotate, the gear wheel 225 engages with the rack 251 to promote said rack 251 to move longitudinally outside of the housing; then the rack component 215 drives the chain guide 9 to move in the same direction outside of the housing away from the sprocket wheel 7 and to tension the saw chain (not shown in the FIG.). The detent overload clutch 400 is a rotation and connection device installed between the rotating device 218 and the gear wheel 225, which is used to connect the rotating device 218 and the gear wheel 225. This detent overload clutch 400 includes a first clutch 222, a second clutch 224 and a spring 220; in the detent overload clutch 400, the gear wheel 225 is installed on the side of the second clutch 224 that is close to the rack component 215 with no relative rotation, while the other side of the second clutch 224 constitutes the first clip member 221; the first clip member 221 of the first clutch 222 and the second clip member 241 of the second clutch 224 are facing the clip and clutch device, and the spring 220 is installed between the first clutch 222 and the hand wheel 281, the two ends of which leans apart against the first clutch 222 and the hand wheel, supply the first clutch 222 with a force toward the second clutch 224. Through the cooperation between the first clutch 222, the second clutch 224 and the spring 220, a clip and clutch force is generated, in which, the clip and clutch force refers to the force generated from the engagement of the first clip member 221 of the first clutch 222 with the second clip member 241 of the second clutch 224. The spring 220 biases the first clutch 222 in the axial direction of the first clutch 222 and the second clutch 224, and leans on the second clutch 224, so there will be a certain pressure between the first clutch 222 and the second clutch 224. When the detent overload clutch 400 conduct engaging and disengaging, the pressure of the first clutch 222 imposed on the second clutch 224 will reach its limit value. The clip and clutch force is preset in accordance with the optimum tension of the saw chain, i.e., the spring force of the detent overload clutch 400 is preset in accordance with the tension required by the saw chain. This tension is determined by the clip and clutch force preset by the clip and clutch device 400 in the factory, and it is not related to the personal feeling of the user, which makes it convenient for the user to reach the pre-designed tension state of the saw chain to realize optimum working process. During the tensioning process, when the saw chain has completely fallen into the guide groove on the longitudinal edge of the chain guide 9, the movement resistance for the chain guide 9 increases gradually, the rotating device 218 keeps moving until the constraint force of the saw chain on the moving chain guide 9 exceeds the clip and clutch force of the detent overload clutch 400, the detent overload clutch 400 makes the rotating device 218 unable to drive the gear wheel 225 to move, and the rotating device 218 keeps pressing against the chain guide 9 while the gear wheel 225 keeps a static state at this moment, i.e., the saw chain 2 has maintained a certain tension. Therefore, the detent overload clutch 400 can ensure that after being tensioned, the saw chain can maintain the same tension, in which, the periphery outer wall of the first clutch 222 is installed with the teeth 274.

In this embodiment, the rotating device 218 includes a clamping sleeve 282 and a hand wheel 281 relatively static to the clamping sleeve 282, and the clamping sleeve 282 and the hand wheel 281 are engaged in a way for the convenience of the operation and control of the operator; the clamping sleeve 282 has a central axis 283, and along the central axis 283, it passed through the spring 220 of the detent overload clutch 400, the first clutch 222, the second clutch 224 and the gear wheel 225 which is fixed on the second clutch 224, and the central axis 283 of the clamping sleeve 282 is coaxial with the rotation axis centre line of said spring 220, the first clutch 222, the second clutch 224 and the gear wheel 225. Of which, the inner edge of the hand wheel 281 is at least movably installed with one clip member 216 through the screw 217, and this clip member 216 includes the clipping part 216*a* which matches the teeth 274 of the first clutch 222 in shape; in order to cooperate with the connection part of the clip member 216, the hand wheel 281 is installed with corresponding connection part 262 to cooperate with the screw 217; a torsion spring 261 is installed between each clip member 216 and the hand wheel 281, and this torsion spring 261 can supply the clipping part 216*a* of the clip member 216 with an elastic force toward the center of the hand wheel 281, so that when the hand wheel 281 is connected to the detent overload clutch 400, the clipping part 216*a* of the clip member 216 can be one-way engaged with the teeth 274 on the outer periphery of the first clutch 222, so a one-way driver will be formed between the rotating device 218 and the detent overload clutch 400 This one-way driver makes the hand wheel 281 rotate and drive the clip member 216 to rotate when the rotating device 218 is rotating; while the clip member 216 can only one-way drive the teeth 274 to rotate, i.e., it drives the first clutch 222 to rotate, so clip connection between the first clutch 222 and the second clutch 224 will tension the saw chain 225; when changing the saw chain, the rotating device 281 has to be rotated backward, and the clipping part 216*a* of the clip member 216 only crawls on the teeth 274 while not driving the first clutch 222 to rotate; at this moment the first clutch 222 maintains static while the hand wheel 281 keeps rotating backwardly, which can also drives the clamping sleeve 252 to come off its engagement with the bolt 37 backwardly, so that the shield 13 can drive the tensioning device to come off the chain saw. Therefore, when changing the saw chain, just rotate the rotating device 218 in a reverse direction without the necessity of overcoming the clipping resistance between the first clutch 222 and the second clutch 224 of the detent overload clutch 400. In addition to the single gripper ratchet mechanism disclosed in this embodiment, technicians in this field can also choose other one-way drivers, such as the OWC (one-way clutch), one-way bearing and other end-tooth ratchet mechanisms, internally connected ratchet mechanisms or fan-shaped ratchet mechanisms disclosed in the mechanic manual to realize one-way driving between the rotating device 218 and the detent overload clutch 400. Of course, hydraulic or pneumatic one-way valve can also realize one-way hydraulic or pneumatic transmission.

The tensioning device also includes an anti-looseness device 226 installed on the side of the clamping sleeve 282 that is close to the chain guide 2, and this anti-looseness device 226 is installed between the detent overload clutch 400 and the chain guide 9. Of which, the anti-looseness device 226 includes a hole 238 coaxial with the center axis 283 of the clamping sleeve 282, and the clamping sleeve 282 passes through its opening 238 and is connected with the bolt 37; on the side of the anti-looseness device 226 that is close to the chain guide 9, the periphery is at least installed with a second anti-looseness tooth 266, the second anti-looseness tooth 266 can engage with the first anti-looseness tooth 252 which is disposed on the rack component 215. The tensioning device also includes a check ring 228 installed on the end of the clamping sleeve 282 close to the chain guide 9, which is used to limit the anti-looseness device 226 and the detent overload clutch 400 to prevent the anti-looseness device 226 and the detent overload clutch 400 from coming off the clamping sleeve 282 and ensure stability of the tensioning device. After the chain saw has been tensioned, during further rotation of the rotating device 218, the clamping sleeve 282 and the anti-looseness device 226 connected to the clamping sleeve 282 keep moving toward the direction of the chain guide 9, so as to press tightly against the chain guide 9. At this moment, under the pressing force, the anti-looseness tooth 266 of the anti-looseness device 226 and the anti-looseness tooth 252 of the rack component 215 engage with each other and form a ratchet gear to keep a certain tension of the chain saw and a certain pressure against the chain guide 9, as well as to effectively prevent the saw chain from loosening due to vibration during the operation of the chain saw 5; in the meantime, it can also prevent chain jamming due to loosening of the chain saw and ensure the safety of the user.

The clamping sleeve 282 passes through a circular shield opening 239 of the shield coaxial with the clamping sleeve 282; this shield opening 239 matches with the shape of the hand wheel 281, which makes it possible for the hand wheel 281 to be inserted into the shield opening 239 and drive the clamping sleeve 282 to move corresponding to the shield 300. The check ring 228 is installed in the back side of the shield 300 of the hand wheel 281, it limits the tensioning device to make this tensioning device installed in this shield 300, and it can be removed from the housing 6 together with the shield 300.

Through the structure mentioned above, the saw chain tensioning and the chain guide pressing of the chain saw in this embodiment is realized this way: when the user gets the chain saw 5 and needs to tension the saw chain, firstly, the shield 300 and the tensioning device need to be covered at the corresponding location on the housing 6, i.e., the shield 300 totally covers the sprocket wheel 7 on the housing 6 and the chain guide 9 partially contained in the housing 6, and in the meantime, the clamping sleeve 282 aims at the bolt 37 which vertically extends from the housing 6. Then, rotate the hand wheel 281, and the hand wheel 281 drives the clamping sleeve 282 to move longitudinally toward the chain guide 9 on the bolt 37 through screw thread fit; in the meantime, the first clutch 222 relatively static to the clamping sleeve 282 drives the second clutch 224 engaged with it to rotate, which then drives the gear wheel 225 relatively static to the second clutch 224 to rotate; the gear wheel 225 drives the rack 251 of the rack component 215 fixed on the chain guide 9 to move longitudinally toward the direction away from the housing 6, which makes the chain guide 9 to move correspondingly toward the direction away from the housing 6, and the saw chain begins to be tensioned. During the tensioning process of the saw chain, the tension of the saw chain forms a constraint to the reacting force of the chain guide 9, this constraint is transmitted to the gear wheel 225 which matches the rack 251 of the rack component 215 through the rack component 215 set on the chain guide, and it is further transmitted to the detent overload clutch 400 installed between the gear wheel 225 and the rotating device 218. Rotate the hand wheel 281, when the tension of the saw chain is smaller than the preset clip and clutch force of the detent overload clutch, the saw chain begins to be tensioned; when the saw chain reaches the optimum tension preset in the factory, keep rotating the hand wheel 281, this reacting force becomes bigger than the clip and clutch force, the detent overload clutch is affected by this reacting force, and the first clip member 221 of the first clutch 222 and the second clip member 241 of the second clutch 224 in the detent overload clutch are disengaged; because the clip members in this embodiment are equipped with latch, so the first clip member 221 crawls on the teeth of the second clip member 241, the first clutch 222 cannot drive the second clutch 224 to move, and there is disengagement in the detent overload clutch 400. The gear wheel 225 keeps its current static state, and the saw chain keeps the tension degree unchanged. After the saw chain has been tensioned, keep rotating the hand wheel 281 to drive the clamping sleeve 282 and the anti-looseness device 226 connected to the clamping sleeve 282 to keep moving toward the direction of the chain guide 9 and press tightly against the chain guide 9; in the meantime, the second anti-looseness tooth 266 of the anti-looseness device 926 is engaged with the first anti-looseness tooth 252 of the rack component 215 to lock the position of the chain guide 9 and finish tensioning of the saw chain and locking of the chain guide 9, and anti-looseness can be realized at the same time with convenient and simple operation.

The invention claimed is:

1. A Chain saw, comprising:

a housing;

a sprocket wheel provided in the housing for driving a saw chain;

a chain guide for guiding the movement of the saw chain, the chain guide extending out longitudinally from the housing and being movable longitudinally relative to the housing; and a chain tensioning device, wherein the chain tensioning device comprises a driven member arranged on the chain guide, a driving member which drives the driven member to move the chain guide longitudinally, a rotating device configured to rotate the driving member, and a stepless clutch device arranged between the rotating device and the driving member, wherein the stepless clutch device is a friction clutch which comprises a first elastic component providing friction pressure and a friction plate subassembly biased by the first elastic component, and wherein the stepless clutch device is configured to be movable relative to the rotating device, and a second elastic component is disposed between the rotating device and the stepless clutch device and the friction pressure is independent of the second elastic component, wherein the friction plate subassembly comprises at least one friction plate, a rotating sleeve being sleeved on a periphery of the at least one friction plate, and a friction plate base being driven to rotate by the at least one friction plate, the friction plate base connects the driving member with the at least one friction plate, the first elastic component is disposed between the friction plate base and the at least one friction plate, the driving member is configured as an eccentric wheel, and the driven member is configured as a mounting stud fixed on the chain guide.

2. The chain saw according to claim 1, wherein the second elastic component is configured to bias the stepless clutch device away from the rotating device.

3. The chain saw according to claim 1, wherein a one-way driver is disposed between the rotating device and the friction clutch.

4. The chain saw according to claim 3, wherein the one-way driver comprises a clip member arranged on the rotating device, and a gear wheel arranged on the friction clutch for engaging with the clip member, the rotating device is configured to drive the friction clutch to rotate along a one-way direction via the clip member.

5. The chain saw according to claim 4, wherein the gear wheel is disposed on a periphery of the rotating sleeve, and the clip member drives the rotating sleeve to rotate synchronously with the rotating device during a saw chain tensioning process.

6. The chain saw according to claim 1, wherein the first elastic component is disposed between the friction plate base and the at least one friction plate.

7. The chain saw according to claim 1, wherein a friction force of the friction clutch is set in accordance with a required saw chain tensioning force of the chain saw.

* * * * *